US010053333B2

(12) United States Patent
Wells et al.

(10) Patent No.: US 10,053,333 B2
(45) Date of Patent: Aug. 21, 2018

(54) PLATFORM LIFT

(71) Applicant: Toyota Motor Engineering & Manufacturing North America, Inc., Erlanger, KY (US)

(72) Inventors: Keith J. Wells, Evansville, IN (US); Robert D. McClain, Haubstadt, IN (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 0 days.

(21) Appl. No.: 15/277,437

(22) Filed: Sep. 27, 2016

(65) Prior Publication Data

US 2018/0086600 A1 Mar. 29, 2018

(51) Int. Cl.

| | |
|---|---|
| ***B66B 7/02*** | (2006.01) |
| ***B66B 9/00*** | (2006.01) |
| ***B66F 7/20*** | (2006.01) |

(52) U.S. Cl.

CPC ..... *B66B 9/00* (2013.01); *B66B 7/02* (2013.01); *B66F 7/20* (2013.01)

(58) Field of Classification Search

CPC ..... B66F 7/20; B66F 1/00; B66F 3/24; B66F 3/25; B66F 7/16; B66F 7/28; B66F 9/02; B66F 9/20

USPC ..... 187/9 E, 213

See application file for complete search history.

(56) References Cited

U.S. PATENT DOCUMENTS

| | | | | | |
|---|---|---|---|---|---|
| 2,080,112 | A * | 5/1937 | Calkins | B66F 7/16 | 73/669 |
| 3,504,889 | A * | 4/1970 | Wyrough | B66F 7/16 | 254/2 R |
| 3,858,688 | A * | 1/1975 | Galloway | B66F 11/04 | 182/141 |
| 3,924,760 | A * | 12/1975 | Lendi | B66F 7/0633 | 414/229 |
| 4,436,183 | A | 3/1984 | Laurich-Trost | | |
| 4,619,346 | A * | 10/1986 | Deguerry | B66F 11/04 | 182/141 |
| 2009/0044332 | A1 | 2/2009 | Parsell et al. | | |

FOREIGN PATENT DOCUMENTS

| | | | | |
|---|---|---|---|---|
| DE | 102013110362 | A1 * | 3/2015 | B66F 7/20 |
| JP | 2008074545 | A | 4/2008 | |

* cited by examiner

*Primary Examiner* — William E Dondero
*Assistant Examiner* — Diem M Tran
(74) *Attorney, Agent, or Firm* — Christopher G. Darrow; Darrow Mustafa PC

(57) ABSTRACT

A platform lift configured for supporting the movement of items between a floor-level area and an elevated area includes a rigid, floor-level platform with two opposed sides, an above-floor mast arranged at each of the opposed sides of the platform, and a knuckle assembly coupling each mast to its respective side of the platform. The masts together support the platform for movement in a lifting direction normal to the platform, and each include an actuator coupled to its respective side of the platform that is selectively operable to impart lifting movement thereto in the lifting direction. The knuckle assemblies together permit the platform's rotation towards and away from the masts when their respective actuators impart different amounts of lifting movement to the opposed sides of the platform in the lifting direction.

20 Claims, 6 Drawing Sheets

PLATFORM LIFT

TECHNICAL FIELD

The embodiments disclosed herein generally relate to lifts, and more specifically to platform lifts used in industrial environments, such as assembly plants.

BACKGROUND

Platform lifts are sometimes used in industrial environments, such as assembly plants, that include areas with differences in elevation. Some assembly plants, for instance, include a floor-level loading area and an elevated assembly area. In these assembly plants, after part carriers are loaded with parts at loading areas, platform lifts are sometimes used to lift the part carriers to support their movement to assembly areas, where the part carriers are unloaded of their parts. Conversely, after the part carriers are unloaded of their parts at the assembly areas, platform lifts are sometimes used to lower the part carriers to support their movement back to the loading areas, where the part carriers are re-loaded with parts.

To perform these functions, the platform lifts include platforms that may be selectively lifted and lowered to selectively lift and lower onboard part carriers. In the above-described assembly plants, part carriers may be transferred between the platforms and the floor when the platforms are lowered, and between the platforms and the assembly areas when the platforms are lifted.

In one configuration of platform lifts, their platforms are lifted and lowered from underneath. In this configuration, space is required below the platforms to accommodate lifting componentry. As a result, the platforms, when lowered, must be somewhat elevated from the floor, which may complicate the transfer of part carriers between the platforms and the floor. Otherwise, the lifting componentry must be accommodated in pits, which are both expensive to install and unconducive to the overall flexibility of assembly plants.

SUMMARY

Disclosed herein are embodiments of assembly plants and platform lifts used in assembly plants. In one aspect, a platform lift is configured for supporting the movement of items between a floor-level area and an elevated area. The platform lift includes a rigid, floor-level platform with two opposed sides, an above-floor mast arranged at each of the opposed sides of the platform, and a knuckle assembly coupling each mast to its respective side of the platform. The masts together support the platform for movement in a lifting direction normal to the platform, and each include an actuator coupled to its respective side of the platform that is selectively operable to impart lifting movement thereto in the lifting direction. The knuckle assemblies together permit the platform's rotation towards and away from the masts when their respective actuators impart different amounts of lifting movement to the opposed sides of the platform in the lifting direction.

In another aspect, an assembly plant includes a floor-level area, an elevated area, and a platform lift for supporting the movement of items between the floor-level area and the elevated area. The platform lift includes a rigid, floor-level platform with two opposed sides, an above-floor mast arranged at each of the opposed sides of the platform, and a knuckle assembly coupling each mast to its respective side of the platform. The masts together support the platform for movement in a lifting direction normal to the platform, and each include an actuator coupled to its respective side of the platform that is selectively operable to impart lifting movement thereto in the lifting direction. The knuckle assemblies together permit the platform's rotation towards and away from the masts when their respective actuators impart different amounts of lifting movement to the opposed sides of the platform in the lifting direction.

In yet another aspect, a platform lift is configured for supporting the movement of items between a floor-level area and an elevated area. The platform lift includes a rigid, floor-level platform with two opposed sides, and a pair of above-floor masts arranged at the opposed sides of the platform. Each mast includes a floor-mountable base, an upright portion extending from the base, a linear slide assembly mounted to the upright portion, and a lift plate carried by the linear slide assembly for movement in a lifting direction normal to the platform. Each mast further includes an actuator mounted between the lift plate and the remainder of the mast that is selectively operable to impart lifting movement to the lift plate in the lifting direction. The platform lift further includes a knuckle assembly coupling the lift plate in each mast to its respective side of the platform. The knuckle assemblies together permit the platform's rotation towards and away from the pair of masts when their respective actuators impart, via their respective lift plates, different amounts of lifting movement to the opposed sides of the platform in the lifting direction.

These and other aspects will be described in additional detail below.

BRIEF DESCRIPTION OF THE DRAWINGS

The various features, advantages and other uses of the present embodiments will become more apparent by referring to the following detailed description and drawing in which.

DETAILED DESCRIPTION

This disclosure teaches a platform lift. The platform lift has a floor-level platform implemented by a pair of upright above-floor masts. The pair of masts supports the platform by its sides for movement in a lifting direction, and is selectively operable to lift and lower the platform by its sides in the lifting direction.

Figure 1:
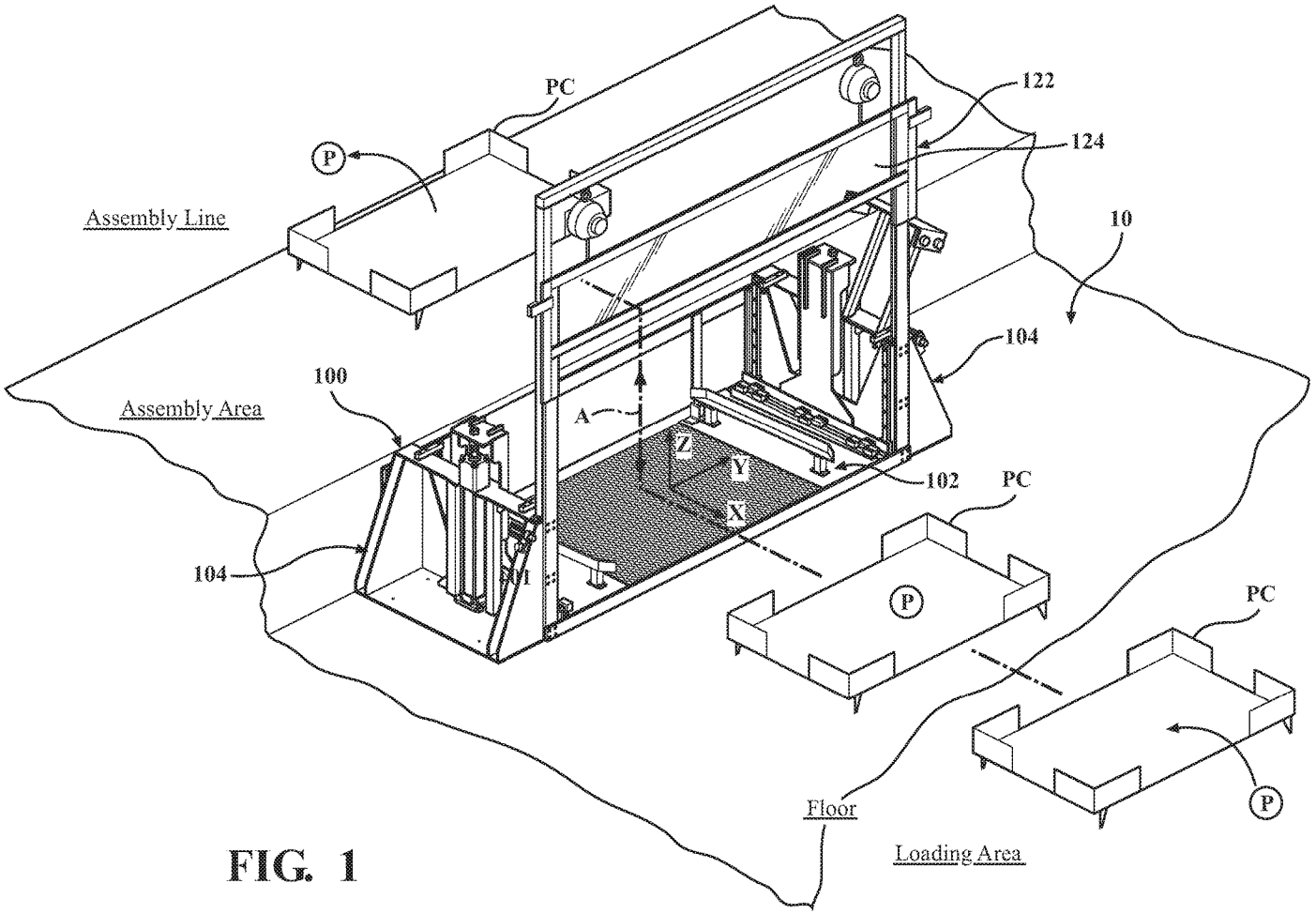
FIG. 1 is a partial perspective view of an assembly plant with a floor-level loading area and an elevated assembly area, as well a platform lift with a floor-level platform configured for lifting and lowering part carriers to support their movement between the loading area and the assembly area.

FIG. 1 shows an example of an assembly plant 10. As shown, the assembly plant 10 includes a floor-level loading area, and an elevated assembly area with an assembly line. The assembly area can be adapted for supporting the assembly of products, such as vehicles, on the assembly line, and the loading area can include parts P configured for assembly into the products on the assembly line. The parts P are illustrated schematically. The parts P can be individual components, collections of similar or different components, sub-assemblies or any other constituent portions of the products. The assembly area may individually support the complete assembly of the products on the assembly line, for example, or be one of multiple assembly areas collectively adapted to support the progressive assembly of the products on the assembly line.

Moveable part carriers PC are used in the assembly plant 10 to carry the parts P and deliver the parts P from the loading area to the assembly area. In general, the part carriers PC are adapted to carry one or more of the parts P, and are subject to being either loaded with one or more parts P or unloaded of one or more of their parts P. A given part carrier PC can be generically shaped and sized to carry a variety of different parts P, for example, or specially shaped and sized to carry an individual specific part P or multiple specific parts P. In the assembly plant 10, the part carriers PC may be moved by operators, either by themselves or using manually-operated tow vehicles, or by automated tow vehicles, such as automated guide vehicles (AVGs).

In the assembly plant 10, the part carriers PC are used to deliver the parts P from the loading area to the assembly area in a repeating process. Initially, one part carrier PC, previously loaded with parts P and left at the assembly area, is unloaded of its parts P, which are assembled into products on the assembly line. Preferably before this part carrier PC is completely unloaded of its parts P, another part carrier PC is loaded with parts P at the loading area. The loaded part carrier PC is then moved from the loading area to the assembly area, and left at the assembly area, where it is unloaded of its parts P. Meanwhile, the unloaded part carrier PC is moved from the assembly area back to the loading area, and left at the loading area, where it is loaded with parts P. The loading area, the assembly area or both may be occupied by one or more operators tasked with loading unloaded part carriers PC with parts P, in the case of the loading area, and unloading loaded part carriers PC of their parts P, in the case of the assembly area.

With the difference in elevation between the floor-level loading area and the elevated assembly area, the part carriers PC must be lifted and lowered as part of their movement between the loading area and the assembly area. As shown in FIG. 1, the assembly plant 10 includes a platform lift 100 that supports this movement by lifting and lowering the part carriers PC.

The assembly plant 10, with the floor-level loading area and the elevated assembly area, is presented as a non-limiting example of an industrial environment in which the platform lift 100 may be implemented. Likewise, the part carriers PC used to deliver the parts P from the loading area to the assembly area are presented as non-limiting examples of items that the platform lift 100, in operation, can lift and lower. It will be understood that the platform lift 100 could be implemented in any industrial or non-industrial environment to lift and lower any items to support their movement between a floor-level area and an elevated area included in that environment.

Figure 2:
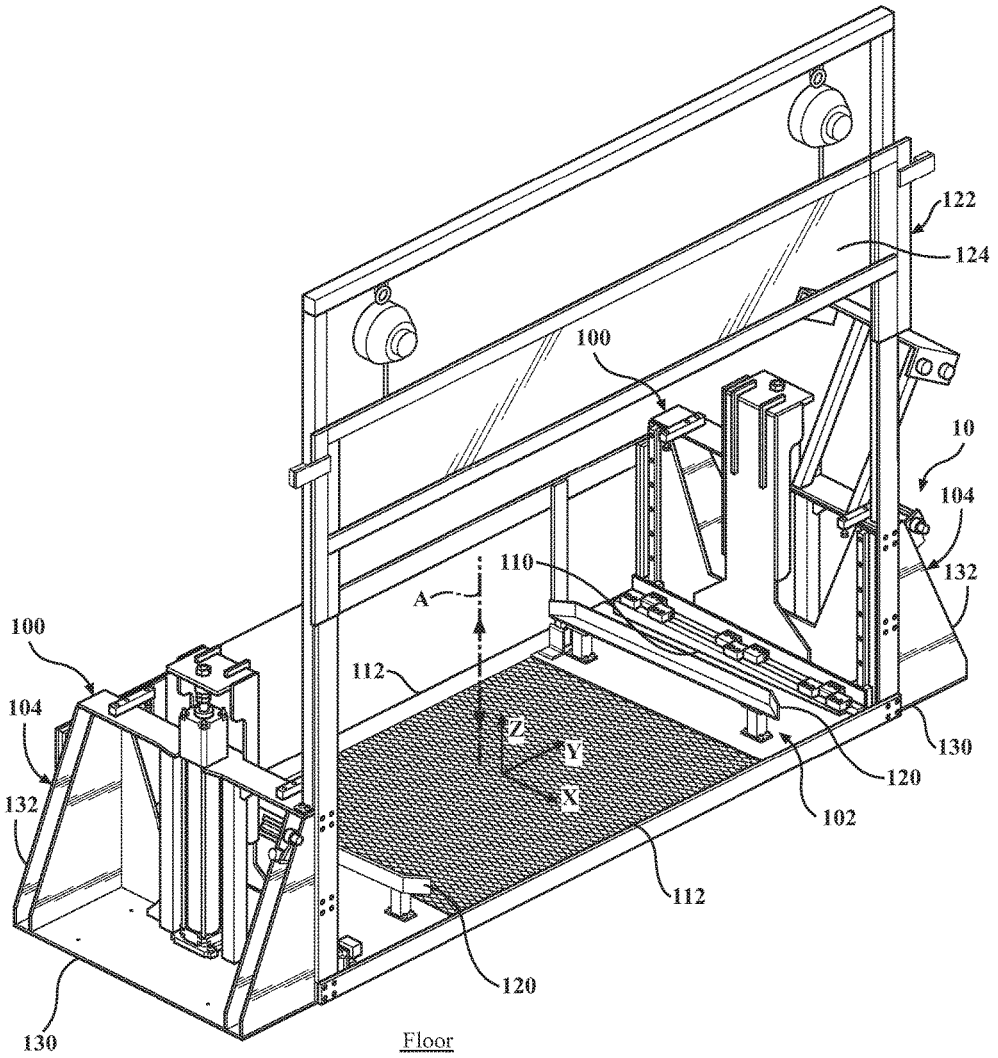
FIG. 2 is a perspective view of the platform lift, showing the platform and a pair of above-floor masts that supports the platform by its sides for movement in a lifting direction, and that is selectively operable to lift and lower the platform by its sides in the lifting direction.

As shown with additional reference to FIG. 2, the platform lift 100 includes a generally planar rigid platform 102. The platform 102 is oriented commonly with the floor. In the indicated X-Y-Z coordinate system, the platform 102 may be oriented in the X-Y plane, for example, or otherwise substantially horizontally. The platform 102 may be constructed from any combination of interconnected frame members, panels and other components. The components of the platform 102 may be interconnected with fasteners, welds, adhesives or any combination of these. The components of the platform 102 may be made from metal or any other suitable material or combination of materials.

The remainder of the platform lift 100 supports the platform 102 for movement in a lifting direction A normal to the platform 102. The lifting direction A may be vertical, in the Z-direction, for example, or otherwise upright. In addition to supporting the platform 102 for movement in the lifting direction A, the remainder of the platform lift 100 is selectively operable to lift and lower the platform 102 in the lifting direction A.

In operation, when the platform 102 is lowered, the part carriers PC may be transferred between the platform 102 and the floor. Loaded part carriers PC moving from the loading area to the assembly area may be transferred from the floor to the platform 102, while unloaded part carriers PC moving from the assembly area back to the loading area may be transferred from the platform 102 to the floor. Similarly, when the platform 102 is lifted, the part carriers PC may be transferred between the platform 102 and the assembly area. Loaded part carriers PC moving from the loading area to the assembly area may be transferred from the platform 102 to the assembly area, while unloaded part carriers PC moving from the assembly area back to the loading area may be transferred from the assembly area to the platform 102.

Once the loaded part carriers PC are transferred to the platform 102 when the platform 102 is lowered, the platform lift 100 is operated to lift the platform 102 in the lifting direction A which, in turn, lifts the onboard loaded part carriers PC for transfer from the platform 102 to the assembly area. Conversely, once the unloaded part carriers PC are transferred to the platform 102 when the platform 102 is lifted, the platform lift 100 is operated to lower the platform 102 in the lifting direction A which, in turn, lowers the onboard unloaded part carriers PC to the floor for transfer from the platform 102 to the floor.

In the platform lift 100, the platform 102 is, as generally shown, floor-level. In other words, when lowered, the platform 102 is substantially not elevated from the floor. The platform 102 may, for example, rest on the floor when lowered. With this configuration of the platform lift 100, when the platform 102 is lowered, the part carriers PC may be transferred directly between the platform 102 and the floor, which simplifies their movement between the loading area and the assembly area.

To implement the floor-level platform 102, the platform lift 100 includes, in addition to the platform 102, a pair of upright above-floor masts 104. The pair of masts 104 is arranged in an opposed, spaced apart relationship at opposing, spaced apart sides 110 of the platform 102 (one indicated, with the other being a mirror image). The platform 102 extends between the pair of masts 104, and is coupled to the pair of masts 104 at its sides 110. The pair of masts 104 supports the platform 102 by its sides 110 for movement in the lifting direction A, and is selectively operable to lift and lower the platform 102 by its sides 110 in the lifting direction A.

Beyond the sides 110 to which the pair of masts 104 is coupled, one, some or all of the remaining sides 112 of the platform 102 are open to the transfer of the part carriers PC to and from the platform 102. Where the platform 102 has, as shown, a generally rectangular footprint, the platform 102 has the sides 110 as two opposing, spaced apart longitudinal sides 110, in the X-direction, at which the pair of masts 104 is coupled, as well as the sides 112 as two opposing, spaced apart lateral sides 112, in the Y-direction, between the longitudinal sides 110. The lateral sides 112 respectively face the loading area and the assembly area, and are open to the transfer of the part carriers PC to and from the platform 102.

The platform 102 may include opposed, spaced apart topside guide rails 120 arranged inside the longitudinal sides 110 of the platform 102, in the X-direction, to guide the transfer of the part carriers PC to and from the platform 102, and help secure the part carriers PC once onboard the platform 102. The platform lift 100 may include a guard 122 arranged at a lateral side 112 of the platform 102. The guard 122 may, as generally shown, be arranged at the lateral side 112 of the platform 102 facing the loading area, for instance. The guard 122 includes a shield 124 subject to being either raised by the remainder of the guard 122 above this lateral side 112 to provide clearance for the transfer of the part carriers PC to and from the platform 102, or lowered by the remainder of the guard 122 in front of this lateral side 112 when the platform 102 is being lifted or lowered. Optionally, another guard 122 could be arranged at the lateral side 112 of the platform 102 facing the assembly area.

In the platform lift 100, with the platform 102 lifted and lowered by its longitudinal sides 110 instead of, for instance, from underneath, the floor-level platform 102 is implemented without the need to accommodate lifting componentry in pits. This configuration of the platform lift 100 not only spares the expense of the otherwise needed pits, but is also more conducive to the overall flexibility of the assembly plant 10.

Figure 3A:
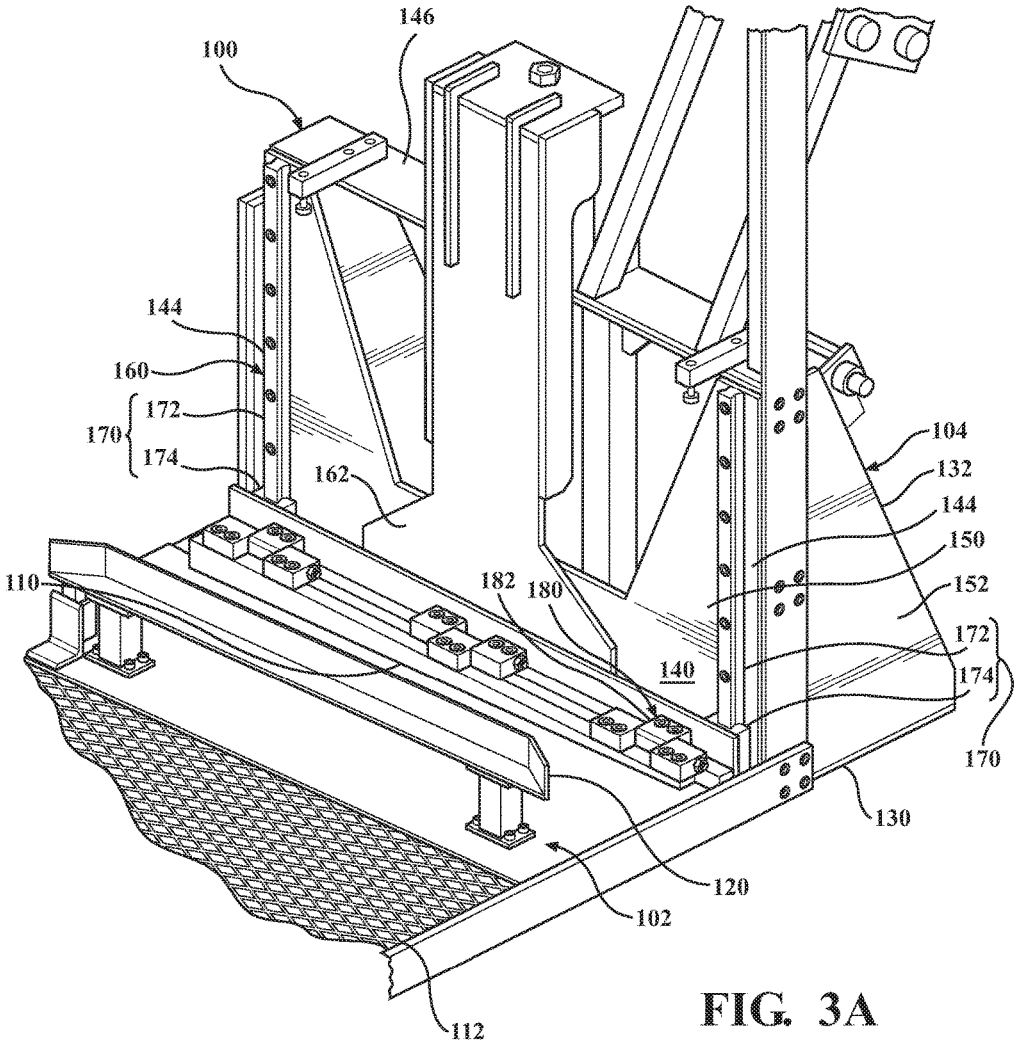
FIGS. 3A and 3B are detailed perspective views of one of the masts, showing linear slides that support the platform for movement in the lifting direction, an actuator that is selectively operable to impart lifting movement to the platform in the lifting direction to lift and lower the platform, and a knuckle assembly coupling the mast to its side of the platform.
Figure 3B:
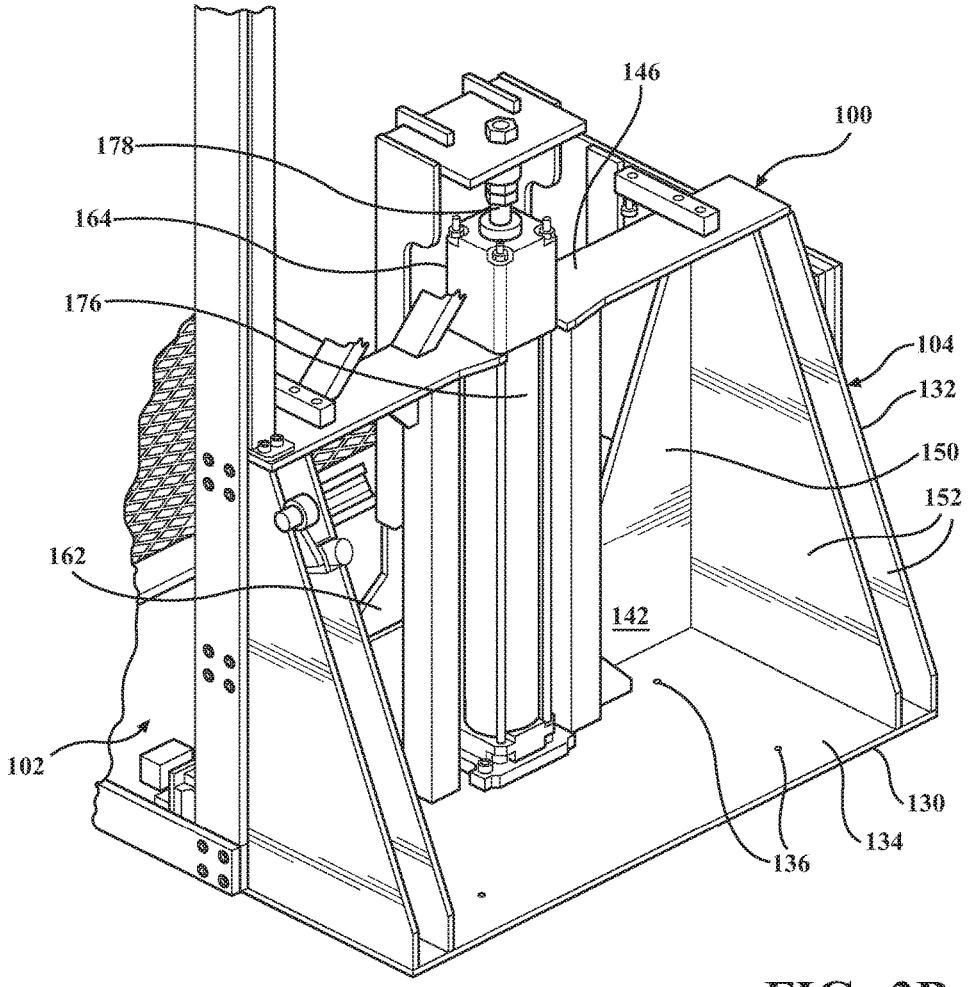

As shown with additional reference to FIGS. 3A and 3B, the structure of the mast 104 arranged at one longitudinal side 110 of the platform 102 (with the other mast 104 being a mirror image that functions the same way with respect to the other longitudinal side 110 of the platform 102) includes a generally planar rigid base 130 and a rigid upright portion 132 extending from the base 130. The base 130, the upright portion 132 and other parts of the mast 104 may be constructed from any combination of interconnected frame members, panels and other components. The components of the mast 104 may be interconnected with fasteners, welds, adhesives or any combination of these. The components of the mast 104 may be made from metal or any other suitable material or combination of materials.

The base 130 rests on the floor outside the longitudinal side 110 of the platform 102. The base 130 is, like the platform 102, oriented commonly with the floor, in the X-Y plane, for example, or otherwise substantially horizontally. The base 130 may, as generally shown, be constructed from a generally rectangular base panel 134. The base panel 134 may have any number of bolt receiving holes 136 by which the mast 104 as a whole is mountable to the floor. In the illustrated mounting configuration, the base panel 134 has a number of bolt receiving holes 136 sized to receive bolts, and the floor is configured to retentively receive bolts extending through the bolt receiving holes 136.

The upright portion 132 is connected at its bottom to the base 130. The upright portion 132 borders the longitudinal side 110 of the platform 102, and has an inside face 140 overlooking the platform 102 and an outside face 142 facing away from the platform 102. The upright portion 132 spans the longitudinal side 110 of the platform 102 and, accordingly, has sides 144 across from the corners of the platform 102 where its longitudinal side 110 meets its two lateral sides 112. The upright portion 132 includes, at its top, an actuator mounting bracket 146. The upright portion 132 may be vertically oriented, in the X-Z plane, for example, or otherwise upright. The upright portion 132 may, as generally shown, be constructed from an upright panel 150 and gussets 152 connected between the base panel 134 and the upright panel 150. According to its illustrated configuration, the upright panel 150 may be generally rectangular with an upper trapezoidal relief. The gussets 152 may be, or include, those connected to the upright panel 150 at the sides 144 of the upright portion 132. According to this construction, the actuator mounting bracket 146 may be connected at the top of the upright portion 132 between the upright panel 150 and the gussets 152.

The mast 104 includes, as part of its supporting structure for the platform 102, a linear slide assembly 160 and a lift plate 162 carried by the linear slide assembly 160. The linear slide assembly 160 supports the platform 102 by its longitudinal side 110 for movement in the lifting direction A. The mast 104 also includes, either as part of or separately from its supporting structure for the platform 102, an actuator 164 by which the mast 104 is selectively operable to lift and lower the platform 102 by its longitudinal side 110 in the lifting direction A. The lift plate 162 is common to the linear slide assembly 160 and the actuator 164, with the linear slide assembly 160 and the actuator 164 both being coupled to the longitudinal side 110 of the platform 102 via the lift plate 162.

The linear slide assembly 160 includes one or more linear slides 170 mounted to the mast 104 and oriented in the lifting direction A. These linear slides 170 may, as generally shown, be mounted to the upright portion 132 of the mast 104 at its inside face 140. In its illustrated configuration, the linear slide assembly 160 includes two linear slides 170 mounted to the inside face 140 of the upright portion 132 in a spaced apart relationship. The two linear slides 170 are arranged, respectively, at the sides 144 of the upright portion 132. In this and other configurations of the linear slide assembly 160, each of its linear slides 170 may have a guide rail 172 mounted to the mast 104 and oriented in the lifting direction A, and a carriage 174 riding on the guide rail 172. The carriage 174 may be or include a sleeve bearing carriage, a ball bearing carriage or a track roller carriage, for example, or any combination of these.

The actuator 164 is mounted to the remainder of the mast 104 and coupled to the longitudinal side 110 of the platform 102. The actuator 164 is subject to selective operation to impart lifting movement to the longitudinal side 110 of the platform 102 in the lifting direction A. The mast 104 as a whole is, in turn, selectively operable to lift and lower the platform 102 by its longitudinal side 110 in the lifting direction A.

The actuator 164 can be any component or combination of components. In its illustrated configuration, the actuator 164 is a linear actuator oriented in the lifting direction A. The actuator 164 may be a pneumatic, hydraulic or motorized linear actuator, for example. The actuator 164 has a body 176 and a guide rod 178, and is subject to selective operation by which the guide rod 178 progressively extends out of the body 176 in an extension stroke, and progressively retracts into the body 176 in a retraction stroke. In this configuration, either the body 176 or the guide rod 178 may be mounted to the remainder of the mast 104, with the other of the body 176 and the guide rod 178 being coupled to the longitudinal side 110 of the platform 102. In this and other configurations of the actuator 164, the actuator 164 may be located at the outside face 142 of the upright portion 132 of the mast 104 between the sides 144 of its upright portion 132, and mounted to the upright portion 132 of the mast 104. In the configuration where the actuator 164 is a linear actuator, the actuator 164 may, as generally shown, sit on the base 130 of the mast 104 and be mounted, by its body 176, to the actuator mounting bracket 146 at the top of the upright portion 132 of the mast 104, as well as to its base 130. In this mounting configuration, with the body 176 of the actuator 164 mounted to the remainder of the mast 104, the guide rod 178 is coupled to the longitudinal side 110 of the platform 102.

The lift plate 162 is located at the inside face 140 of the upright portion 132 of the mast 104, and is carried by the linear slide assembly 160 for movement in the lifting direction A. More specifically, the lift plate 162 is mounted on the carriages 174 riding on the respective guide rails 172 of the two linear slides 170 of the linear slide assembly 160. With the two linear slides 170 arranged, respectively, at the sides 144 of the upright portion 132, the lift plate 162 spans the longitudinal side 110 of the platform 102. The two linear slides 170 are, accordingly, coupled to the longitudinal side 110 of the platform 102 via the lift plate 162 at respective points across from the corners of the platform 102 where its longitudinal side 110 meets its two lateral sides 112.

The lift plate 162 is, in addition to being carried by the linear slide assembly 160 for movement in the lifting direction A, part of a relationship where the actuator 164 is mounted between the lift plate 162 and the remainder of the mast 104. In this relationship, with the actuator 164 coupled to the longitudinal side 110 of the platform 102 via the lift plate 162, the actuator 164, when selectively operated, imparts lifting movement to the lift plate 162 in the lifting direction A and, in turn, to the longitudinal side 110 of the platform 102.

With the actuator 164 being a linear actuator located at the outside face 142 of the upright portion 132 of the mast 104, sitting on its base 130 and oriented in the lifting direction A, the lift plate 162 reaches above the body 176 of the actuator 164 and over the upright portion 132 of the mast 104, and is mounted on the guide rod 178 of the actuator 164. At its location between the sides 144 of the upright portion 132 of the mast 104, the actuator 164 is coupled to the longitudinal side 110 of the platform 102 via the lift plate 162 at a point between the points across from the corners of the platform 102 where its longitudinal side 110 meets its two lateral sides 112, at which the two linear slides 170 are respectively coupled to the longitudinal side 110 of the platform 102 via the lift plate 162. This point may, as generally shown, be midway between the points at which the two linear slides 170 are respectively coupled to the longitudinal side 110 of the platform 102 via the lift plate 162.

The platform lift 100 includes a knuckle assembly 180 by which the mast 104 is coupled to the longitudinal side 110 of the platform 102. The knuckle assembly 180 is, as generally shown, coupled between the lift plate 162 of the mast 104 and the longitudinal side 110 of the platform 102. In the platform lift 100, the pair of masts 104 include separate actuators 164, which are each subject to selective operation to impart lifting movement to a respective lift plate 162 in the lifting direction A and, in turn, to a respective longitudinal side 110 of the platform 102. To accommodate the possibility of the actuators 164 imparting different amounts of lifting movement to the longitudinal sides 110 of the platform 102 in the lifting direction A, the knuckle assembly 180 is permissive of the rotation of the platform 102 towards and away from the mast 104. To facilitate this rotation, the knuckle assembly 180 is, moreover, permissive of the movement of the platform 102 between the pair of masts 104.

The knuckle assembly 180 includes one or more knuckles 182 coupled between the lift plate 162 and the longitudinal side 110 of the platform 102. In its illustrated configuration, the knuckle assembly 180 includes three such knuckles 182 arranged in a spaced apart relationship along the longitudinal side 110 of the platform 102. Two of the three knuckles 182 are arranged, respectively, at the corners of the platform 102 where its longitudinal side 110 meets its two lateral sides 112, while the third knuckle 182 is arranged midway between these corners of the platform 102.

Figure 4A:
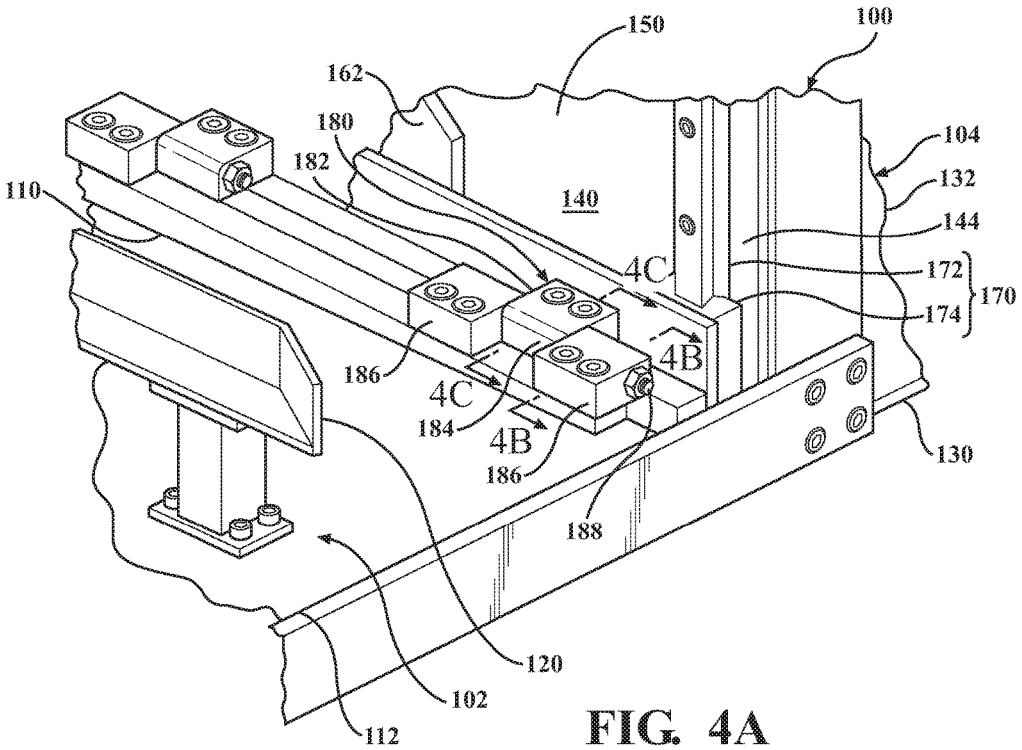
FIG. 4A is a detailed perspective view of a knuckle in the knuckle assembly.
Figure 4B:
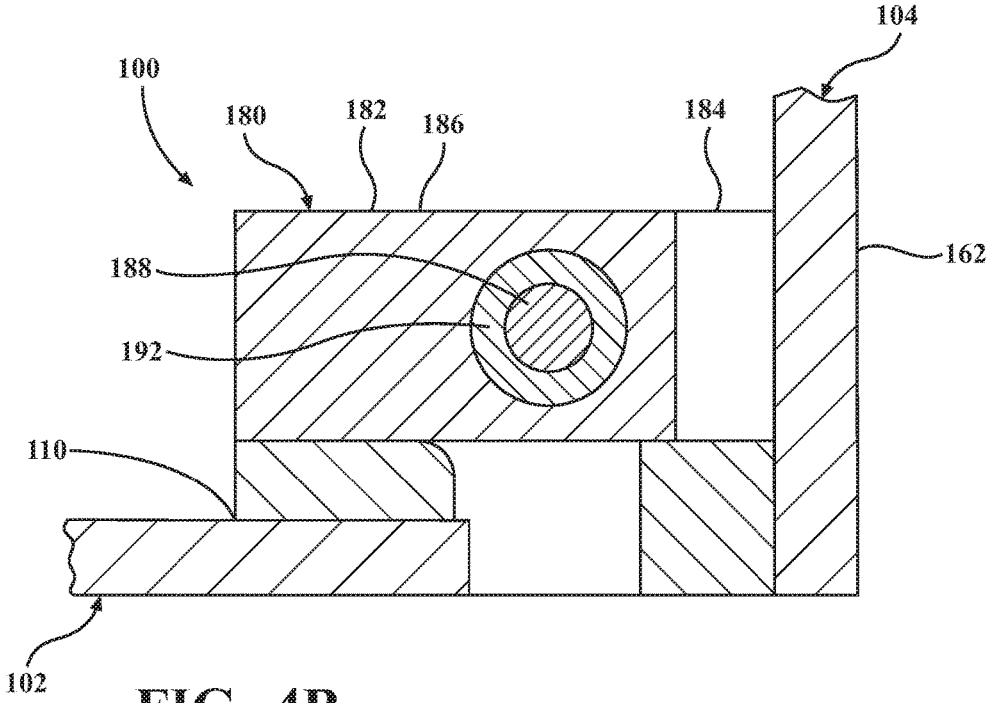
FIGS. 4B and 4C are cross sectional views taken along the lines 4B-4B and 4C-4C, respectively, in FIG. 4A, showing aspects of the knuckle.
Figure 4C:
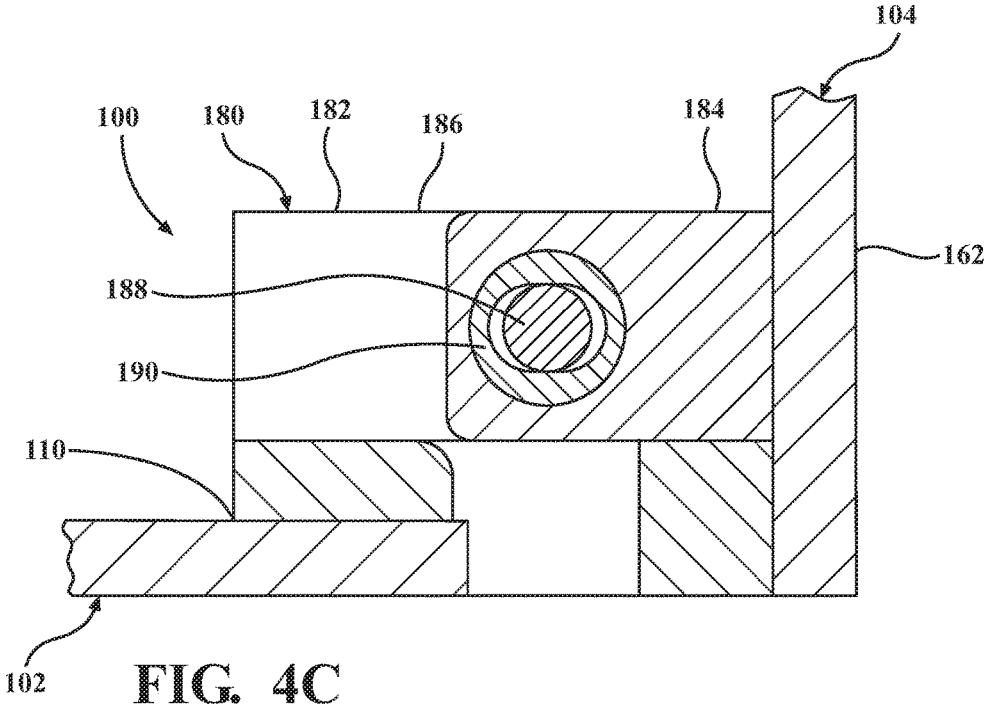

As shown with additional reference to FIGS. 4A-C, in the illustrated configuration of the knuckle assembly 180, each of its knuckles 182 may have one or more mast-side fingers 184 at the lift plate 162 and one or more interleaved platform-side fingers 186 at the longitudinal side 110 of the platform 102, as well as a rod 188 extending through the mast-side fingers 184 and the platform-side fingers 186. In each knuckle 182, the mast-side fingers 184 and the platform-side fingers 186 are pivotable with respect to each other about the rod 188, and about the longitudinal side 110 of the platform 102, in the X-direction. The knuckle assembly 180 as a whole is, in turn, permissive of the rotation of the platform 102 towards and away from the mast 104. To facilitate the rotation of the platform 102 towards and away from the mast 104, there is play in each knuckle 182 by which the knuckle 182 and, in turn, the knuckle assembly 180 as a whole, is permissive of the movement of the platform 102 between the pair of masts 104, in the Y-direction. Although this play may be present in each knuckle 182 of the knuckle assemblies 180 in both of the pair of masts 104, optionally, this play could be present in each knuckle 182 of the knuckle assembly 180 in only one of the pair of masts 104.

As generally shown, the mast-side fingers 184 may be mounted to the lift plate 162, while the platform-side fingers 186 may be mounted to the platform 102 at its longitudinal side 110. Optionally, the mast-side fingers 184 and the platform-side fingers 186 may house respective bushings 190 and 192. In this configuration, the bushings 190 and 192 housed in the mast-side fingers 184 and the platform-side fingers 186 are coaxially aligned with the rod 188, and the rod 188 extends through the bushings 190 and 192. In this and other configurations of the knuckle 182, the play in each knuckle 182, by which it is permissive of the movement of the platform 102 between the pair of masts 104, may be the result of play between the rod 188 and either or both of the mast-side fingers 184 and the platform-side fingers 186. For example, as generally shown, in the configuration where the mast-side fingers 184 and the platform-side fingers 186 house respective bushings 190 and 192, the bushings 190 housed by the mast-side fingers 184 may have oblong through holes to create otherwise unnecessary clearance for the rod 188. Optionally, the bushings 192 housed by the platform-side fingers 186 could have the oblong through holes to create otherwise unnecessary clearance for the rod 188.

The platform lift 100 embodies a modular design subject to a wide range of adjustments benefiting the overall flexibility of the assembly plant 10. For instance, the pair of masts 104, being floor-mounted, may be arranged at the respective longitudinal sides 110 of a variety of different sized platforms 102. Further, in the configuration where the actuators 164 in the pair of masts are linear actuators, actuators 164 with different strokes may be employed to adjust the amount that the platform lift 100 can lift and lower the platform 102 and onboard items. Moreover, in this and other configurations of the actuators 164, actuators 164 with different capacities may be employed to adjust the overall capacity of the platform lift 100 to lift and lower the platform 102 and onboard items.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A platform lift for supporting the movement of items between a floor-level area and an elevated area, comprising:
- a rigid, floor-level platform with two opposed sides;
- an above-floor mast arranged at each of the opposed sides of the platform, the masts together supporting the platform for movement in a lifting direction normal to the platform, and each including an actuator coupled to its respective side of the platform that is selectively operable to impart lifting movement thereto in the lifting direction; and
- a knuckle assembly coupling each mast to its respective side of the platform, the knuckle assemblies together permitting the platform's rotation towards and away from the masts when their respective actuators impart different amounts of lifting movement to the opposed sides of the platform in the lifting direction.

2. The platform lift of claim 1, wherein the platform has, in addition to the two opposed sides at which the masts are arranged, at least one side open to the transfer of items to and from the platform.

3. The platform lift of claim 1, wherein each mast includes a linear slide assembly coupled to its respective side of the platform, with the linear slide assemblies together supporting the platform for movement in the lifting direction.

4. The platform lift of claim 1, wherein each mast includes two linear slides coupled to its respective side of the platform, with the linear slides together supporting the platform for movement in the lifting direction.

5. The platform lift of claim 4, wherein, in each mast, a point at which the actuator is coupled to its respective side of the platform is between two points at which the two linear slides are respectively coupled to its respective side of the platform.

6. The platform lift of claim 1, wherein, in each mast, the actuator is a linear actuator having a body and a guide rod, with one of the body and the guide rod mounted to the remainder of the mast, and the other of the body and the guide rod coupled to the mast's respective side of the platform, and with the linear actuator being selectively operable to progressively extend and retract the guide rod to impart lifting movement to the mast's respective side of the platform in the lifting direction.

7. The platform lift of claim 1, wherein at least one of the knuckle assemblies is permissive of the platform's movement in a direction between the masts.

8. An assembly plant, comprising:
- a floor-level area;
- an elevated area; and
- a platform lift for supporting the movement of items between the floor-level area and the elevated area, the platform lift including:
  - a rigid, floor-level platform with two opposed sides;
  - an above-floor mast mounted to the floor at each of the opposed sides of the platform, the masts together supporting the platform for movement in a lifting direction normal to the platform, and each including an actuator coupled to its respective side of the platform that is selectively operable to impart lifting movement thereto in the lifting direction; and
  - a knuckle assembly coupling each mast to its respective side of the platform, the knuckle assemblies together permitting the platform's rotation towards and away from the masts when their respective actuators impart different amounts of lifting movement to the opposed sides of the platform in the lifting direction.

9. The assembly plant of claim 8, wherein, in the platform lift, the platform has, in addition to the two opposed sides at which the masts are arranged, at least one side open to the transfer of items to and from the platform.

10. The assembly plant of claim 8, wherein, in the platform lift, each mast includes a linear slide assembly coupled to its respective side of the platform, with the linear slide assemblies together supporting the platform for movement in the lifting direction.

11. The assembly plant of claim 8, wherein, in the platform lift, each mast includes two linear slides coupled to its respective side of the platform, with the linear slides together supporting the platform for movement in the lifting direction.

12. The assembly plant of claim 11, wherein, in the platform lift, in each mast, a point at which the actuator is coupled to its respective side of the platform is between two points at which the two linear slides are respectively coupled to its respective side of the platform.

13. The assembly plant of claim 8, wherein, in the platform lift, in each mast, the actuator is a linear actuator having a body and a guide rod, with one of the body and the guide rod mounted to the remainder of the mast, and the other of the body and the guide rod coupled to the mast's respective side of the platform, and with the linear actuator being selectively operable to progressively extend and retract the guide rod to impart lifting movement to the mast's respective side of the platform in the lifting direction.

14. The assembly plant of claim 8, wherein, in the platform lift, at least one of the knuckle assemblies is permissive of the platform's movement in a direction between the masts.

15. A platform lift for supporting the movement of items between a floor-level area and an elevated area, comprising:
- a rigid, floor-level platform with two opposed sides;
- a pair of above-floor masts arranged at the opposed sides of the platform, each mast including:
  - a floor-mountable base;
  - an upright portion extending from the base;
  - a linear slide assembly mounted to the upright portion;
  - a lift plate carried by the linear slide assembly for movement in a lifting direction normal to the platform; and an actuator mounted between the lift plate and the remainder of the mast that is selectively operable to impart lifting movement to the lift plate in the lifting direction; and a knuckle assembly coupling the lift plate in each mast to its respective side of the platform, the knuckle assemblies together permitting the platform's rotation towards and away from the pair of masts when their respective actuators impart, via their respective lift plates, different amounts of lifting movement to the opposed sides of the platform in the lifting direction.

16. The platform lift of claim 15, wherein the platform has, in addition to the two opposed sides at which the pair of masts is arranged, at least one side open to the transfer of items to and from the platform.

17. The platform lift of claim 15, wherein each mast includes two linear slides mounted to the upright portion, with the lift plate being carried by the two linear slides for movement in the lifting direction.

18. The platform lift of claim 17, wherein, in each mast, a point at which the actuator is mounted to the lift plate is between two points at which the lift plate is respectively carried by the two linear slides.

19. The platform lift of claim 15, wherein, in each mast, the actuator is a linear actuator having a body and a guide rod, with one of the body and the guide rod mounted to the remainder of the mast, and the other of the body and the guide rod mounted to the lift plate, and with the linear actuator being selectively operable to progressively extend and retract the guide rod to impart lifting movement, via the lift plate, to the mast's respective side of the platform in the lifting direction.

20. The platform lift of claim 15, wherein:

the knuckle assemblies each include at least one knuckle having one or more mast-side fingers at the lift plate to which the knuckle assembly is coupled, one or more interleaved platform-side fingers at the side of the platform to which the knuckle assembly is coupled, and a rod extending through the one or more mast-side fingers and the one or more platform-side fingers, about which the one or more mast-side fingers and the one or more platform-side fingers are pivotable with respect to each other; and in at least one of the knuckle assemblies, in its at least one knuckle, there is play between the rod and at least one of the one or more mast-side fingers and the one or more platform-side fingers, whereby the at least one knuckle is permissive of the platform's movement in a direction between the pair of masts.

* * * * *